US009375118B2

(12) United States Patent
Granger

(10) Patent No.: US 9,375,118 B2
(45) Date of Patent: Jun. 28, 2016

(54) DEVICE FOR DISPENSING PRE-CUT ROLLED OR Z-FOLDED WIPING MATERIAL

(76) Inventor: Maurice Granger, St. Priest en Jarez (FR)

( * ) Notice: Subject to any disclaimer, the term of this patent is extended or adjusted under 35 U.S.C. 154(b) by 262 days.

(21) Appl. No.: 13/979,334

(22) PCT Filed: Nov. 4, 2011

(86) PCT No.: PCT/FR2011/052574
§ 371 (c)(1),
(2), (4) Date: Aug. 12, 2013

(87) PCT Pub. No.: WO2012/095568
PCT Pub. Date: Jul. 19, 2012

(65) Prior Publication Data

US 2013/0320132 A1 Dec. 5, 2013

(30) Foreign Application Priority Data

Jan. 11, 2011 (FR) ..... 11 50230

(51) Int. Cl.
*A47K 10/34* (2006.01)
*A47K 10/32* (2006.01)

(52) U.S. Cl.
CPC ..... *A47K 10/34* (2013.01); *A47K 2010/3233* (2013.01)

(58) Field of Classification Search
CPC ..... A47K 10/3656; A47K 2010/3233; A47K 2010/3681; A47K 10/36; A47K 10/34; A47K 10/32; A47K 2010/3246; A47K 2010/326; A47K 2010/3675; A47K 10/3687; A47K 10/38; A47K 201/3881; A47K 10/18; A47K 10/185; A47K 10/3827; A47K 10/42; A47K 10/424; A47K 10/44; B65D 83/08
USPC ..... 242/596, 596.4, 596.8, 598.5, 598.6, 242/579, 580, 580.1, 566, 615.3; 221/33, 221/47, 55, 62, 63
See application file for complete search history.

(56) References Cited

U.S. PATENT DOCUMENTS 2,273,384 A 2/1942 Steiner et al.
2,590,718 A 3/1952 Lundquist
(Continued)

FOREIGN PATENT DOCUMENTS

EP 0 034 121 B1 8/1981
EP 0 387 160 B 9/1990
(Continued)

*Primary Examiner* — Sang Kim
*Assistant Examiner* — Nathaniel Adams
(74) *Attorney, Agent, or Firm* — Seed IP Law Group PLLC

(57) ABSTRACT

The invention relates to an apparatus including a housing having a cover and a pivotably mounted flap, said housing receiving a module that receives the strip of precut material. Said module is arranged with a transverse supporting plate, and a flap that is pivotably mounted relative to said module and to said supporting plate while being placed in front of the latter and opposite the inner front surface of the cover so as to enable the material strip to pass therethrough. The module hingedly receives, in front of the flap, a cover plate that is profiled, on the top edge thereof, with an edge, which is oriented toward the inside of the flap and which is suitable for projecting from the top of said flap so as to make it possible to guide the material strip between said flap and said cover plate. Said flap and the cover plate are arranged in a complementary manner on both sides of central notches, with one or more slots and one or more ribs that are capable of penetrating into said slot(s) when closing the cover, wherein the flap and the transverse supporting plate are coupled together so as to be limitedly pivotable such that the operator can access the inner space between the flap and the cover plate.

11 Claims, 8 Drawing Sheets

(56) References Cited

U.S. PATENT DOCUMENTS

| | | | | |
|---|---|---|---|---|
| 2,683,641 | A | 7/1954 | Larson | |
| 2,695,208 | A | 11/1954 | Graham | |
| 2,832,549 | A * | 4/1958 | Youngberg | A47K 10/38 225/69 |
| 4,165,138 | A * | 8/1979 | Hedge | A47K 10/3687 242/560 |
| 4,389,026 | A | 6/1983 | Willa et al. | |
| 4,467,974 | A | 8/1984 | Crim | |
| 4,611,768 | A | 9/1986 | Voss et al. | |
| 5,207,633 | A | 5/1993 | Granger | |
| 5,335,811 | A | 8/1994 | Morand | |
| 5,897,074 | A | 4/1999 | Marino | |
| 6,202,956 | B1 | 3/2001 | Grasso et al. | |
| 6,736,348 | B1 | 5/2004 | Formon et al. | |
| 7,040,567 | B1 | 5/2006 | Lewis et al. | |
| 7,093,737 | B2 | 8/2006 | Tramontina et al. | |
| 8,191,736 | B2 | 6/2012 | Beranger | |
| 8,672,255 | B2 | 3/2014 | Granger | |
| 1,135,658 | A1 | 4/2015 | Brown et al. | |
| 2010/0001015 | A1 | 1/2010 | Thoren et al. | |
| 2011/0089213 | A1 | 4/2011 | Granger | |
| 2011/0101020 | A1 | 5/2011 | Granger | |
| 2011/0174833 | A1 | 7/2011 | Granger | |
| 2011/0284681 | A1 | 11/2011 | Granger | |
| 2013/0256450 | A1 | 10/2013 | Granger | |
| 2013/0277492 | A1 | 10/2013 | Granger | |
| 2013/0320132 | A1 | 12/2013 | Granger | |
| 2013/0334272 | A1 | 12/2013 | Granger | |

FOREIGN PATENT DOCUMENTS

| | | | |
|---|---|---|---|
| FR | 957 096 | | 10/1947 |
| FR | 1 060 322 | | 4/1952 |
| FR | 1 058 449 | | 3/1954 |
| FR | 1 058 471 | | 3/1954 |
| FR | 1 059 244 | | 3/1954 |
| FR | 2 931 350 | A1 | 11/2009 |
| FR | 2 960 760 | A1 | 12/2011 |
| FR | 2 966 034 | A1 | 4/2012 |
| FR | 2 968 530 | A1 | 6/2012 |
| FR | 2 970 167 | A1 | 7/2012 |
| FR | 2 983 694 | A1 | 6/2013 |
| WO | 2009/150342 | A2 | 12/2009 |
| WO | 2009/150351 | A1 | 12/2009 |
| WO | 2010/007261 | A1 | 1/2010 |
| WO | 2010/034915 | A1 | 4/2010 |
| WO | 2010/063917 | A1 | 6/2010 |
| WO | 2010/089467 | A1 | 8/2010 |

* cited by examiner

Fig. 3
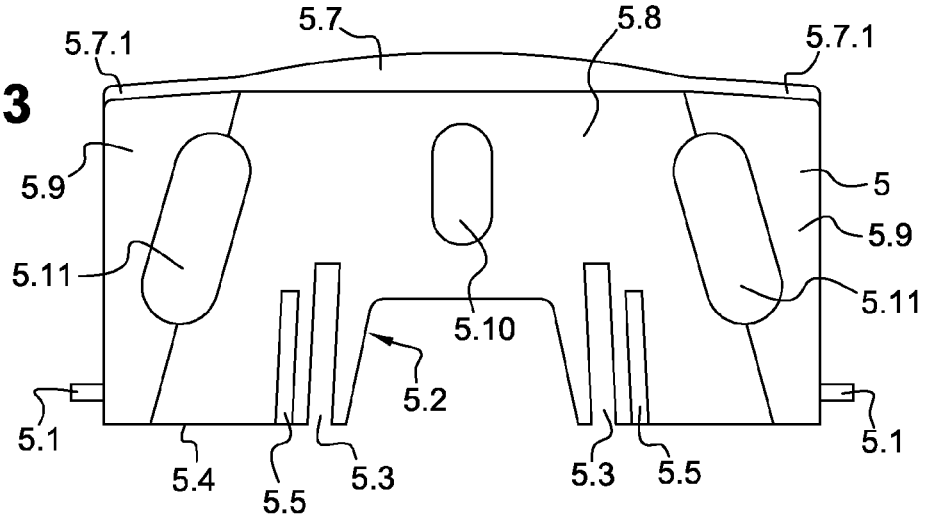
Fig. 4
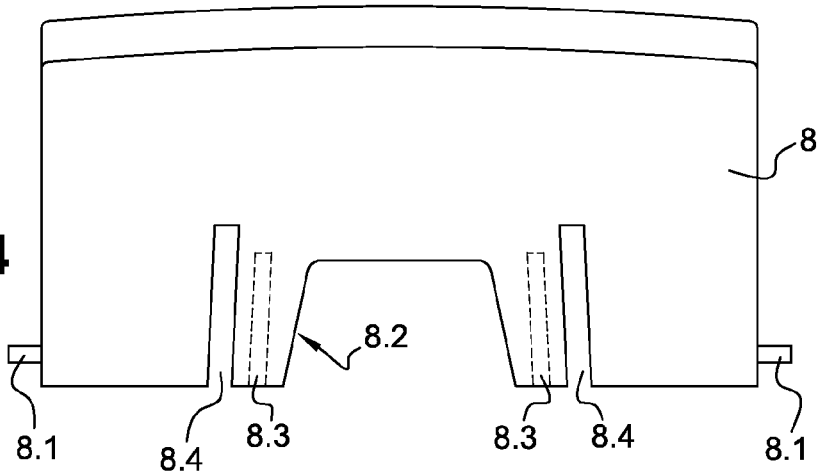
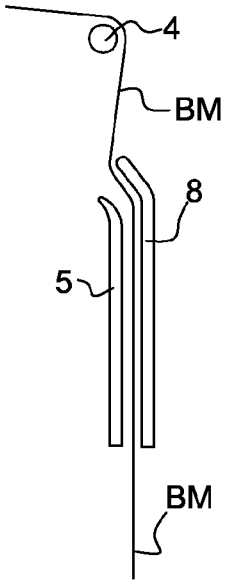
Fig. 5

DEVICE FOR DISPENSING PRE-CUT ROLLED OR Z-FOLDED WIPING MATERIAL

BACKGROUND

1. Technical Field

The present disclosure relates to the technical field of devices for dispensing wiping materials of soft tissue type, such as hand wipes, toilet paper, and for general wiping and cleaning applications.

2. Description of the Related Art

The Applicant has already worked on dispensers providing pre-cut wiping material. Different technical solutions have thus been provided, which have been described in patents WO 2010/089467, WO 2010/063917, WO 2010/034915, WO 2010/007261, WO 2009/150342.

A complementary development has been brought to patent WO 2010/089467 by French patent FR 1058449 with, in particular, the arranging of a cover capable of being raised to close the device, and including a device for cleaning the strip of pre-cut material.

This last device is of the type comprising a housing directly or indirectly receiving the pre-cut wiping material intended to be dispensed. This housing, of parallelepipedal shape, receives a closing cover which may be hinged to be opened or closed by being raised upwards and then locked. Such a housing may be fitted with a module for receiving the material. Such a module thus comprises a front transverse support wall for receiving different means. The strip of material is guided in any appropriate manner by the module, to be conveyed to the device outlet between the front wall and the opposite surface of the cover. The module is capable of having a flap hinged with respect to the set-back support plate. The flap is arranged directly opposite to the internal surface of the cover, with the material passing in the space between the two. In this specific configuration, the issue used to be the maintaining of the wiping material flat as it is dispensed. This means that the wiping material should not be folded or creased, so that it remains flat all throughout its surface.

The Applicant has, in such conditions, designed and developed a technical solution disclosed in French patent application FR 1058471. According to this application, the device for dispensing a rolled or folded pre-cut wiping material comprises a housing with an associated cover raised from the top. The housing receives a module capable of being quickly assembled and removed receiving the strip of pre-cut material. The module is provided with a transverse support plate capable of receiving small shaped plates capable of resiliently pivoting. A flap is pivotally assembled with respect to said module and to the support plate by being arranged in front of it and opposite to the inner front surface of the cover, to allow the passing of the strip of material. The flap, the small plates, and the cover are fitted with means enabling to dispense the pre-cut strip of material in such a way that it remains flat.

In French patent application FR 1058471, a pivoting flap which is fitted on its edges with swivel axes to enable it to pivot towards the back is arranged at the front of the module. The flap is intended to be opposite to the inner surface of the cover on closing thereof, while leaving a space to let the strip of material pass therebetween. The flap has a specific configuration with a central cutout area of trapezoidal configuration, extending at its end in a staged portion, itself having rounded ends. An intermediate horizontal portion is placed between the bottom of the central recess and the lower end of the flap. Two support points are thus formed at the end of the trapezoidal recess and of the horizontal junction plane, having a function which will be specified hereafter.

The module further comprises a transverse support plate also stiffening the module. This support plate is especially intended to receive small shaped plates which are capable of slightly protruding from the lower end of the flap. The small plates are fastened by their upper end to the support plate and are capable of resiliently pivoting against pull-back means. Two small plates are thus arranged and are located on either side of the trapezoidal opening located in the median plane of the flap. The small plates protrude from the flap in its lower portion and they are each fitted with at least one, and preferably two obliquely-arranged tongues. These pairs of tongues face outwards with respect to the trapezoidal cutout of the flap.

In the context of French patent application FR 1059244, the cover is fitted with a transverse guide bar arranged in the lower portion of said cover between its lateral flanges. The guide bar is located, on raising of the cover, in a plane higher than the upper portion of the flap and in a set-back plane. The cover has a central recess with, on either side, hollow patterns for cooperating with matching shapes formed on the flap. The pivoting flap has a central area with flat portions interconnected by vertical connection strips providing a curved configuration. Said flap has a second area formed by an upper band curved with respect to the portions in an inward-directed plane. The flap has a third area in its lower portion provided with a central recess continued by connection walls comprising protruding means cooperating with the hollow patterns formed on the cover, and boss-shaped means receiving stop axes for cooperating with stop pads arranged on the support plate.

In the context of French patent application FR 1060322, modifications have been made at the same time to the pivotally-assembled flap with respect to the module and to the support plate, and in relation with the device cover. More specifically, the flap has at least one recess enabling to catch the strip of material and at least one long slot arranged in a plane forming an angle with respect to the lower edge of the flap. Said slot thus defines an area for receiving at least one rib formed in a complementary configuration on the cover by penetrating, on closing of the cover, into said slot. The cover has at least one rib fitting into the slot formed on the flap and at least one recess for the passing of the strip of material. At least the rib formed on the cover has a tear drop configuration with a progressive height from its base inside of the cover to the lower end thereof. The rib has in its upper portion a rounded shape having the function of allowing the separability of a format of pre-cut strip of material from the rest of the strip.

Within the framework of his research, the Applicant has desired to further optimize the design of the dispenser of rolled or Z-folded pre-cut wiping material, by using the cover for its sole function of protection of the housing and of the module enabling to dispense the strip of material.

The Applicant has also desired to give the dispenser a greater autonomy of use by providing the possibility of introducing a reserve roll of material when the roll of material in service is nearly depleted.

The Applicant has also worked on the ability to adjust the passage clearance of the strip of material at the device outlet, taking into account the thickness of the strip of material, which may vary according to the nature of the applications of the device, such as the dispensing of hand wipes, toilet paper, or others.

The Applicant's approach also has been to search for a design of a dispenser of pre-cut material which can be able to receive customized protection covers, of different configurations according to the users' needs.

BRIEF SUMMARY

Based on these aims, the Applicant has designed a very high-quality dispenser of pre-cut wiping materials, having a highly reliable operation while including a limited number of components.

According to a first feature, the device for dispensing a rolled or folded pre-cut wiping material comprising a housing with an associated cover closed by being raised upwards, a pivotally-assembled flap, said housing receiving a module capable of being rapidly assembled and removed receiving the strip of pre-cut material, said module comprising a swivel system articulated by bent levers, arranged on either side of the module on closing of the device and enabling to stretch the strip and to guide it, and with a damping function to avoid breaking the material, the cover being free of any functional shape capable of cooperating with the flap, is remarkable in that the cover is closed by being raised upwards, said module being provided with a transverse support plate, and a flap pivotally assembled with respect to said module and to the support plate by being arranged at the front thereof and opposite to the inner front surface of the cover to allow the passing of the strip of material, and in that the module receives at the front of the flap, and in hinged fashion, a very high cover plate shaped at its upper end with an inward-directed border on the flap side capable of protruding from the upper end of said flap to enable to guide the strip of material between said flap and said cover plate, and in that said flap and said cover plate are arranged complementarily on either side of central recesses, with one or several slot(s) and one or several rib(s) capable of penetrating into said slots on closing of the cover, and in that the flap and the transverse support plate are coupled to each other with a limiting pivoting capacity to enable the operator to access the inner volume comprised between the flap and the cover plate.

The foregoing and other features will well appear from the following description.

BRIEF DESCRIPTION OF THE SEVERAL VIEWS OF THE DRAWINGS

The object of the invention is non-limitingly illustrated in the drawings, where FIG. 3 is a front view of the flap, in a first embodiment, FIG. 4 is a front view of a plate for partially covering said flap and guiding the strip of material, in a first embodiment in relation with the shape of the flap of FIG. 3, FIG. 5 is a simplified side view illustrating the passing of the strip of material between said flap and the cover plate.

DETAILED DESCRIPTION

Figure 1:
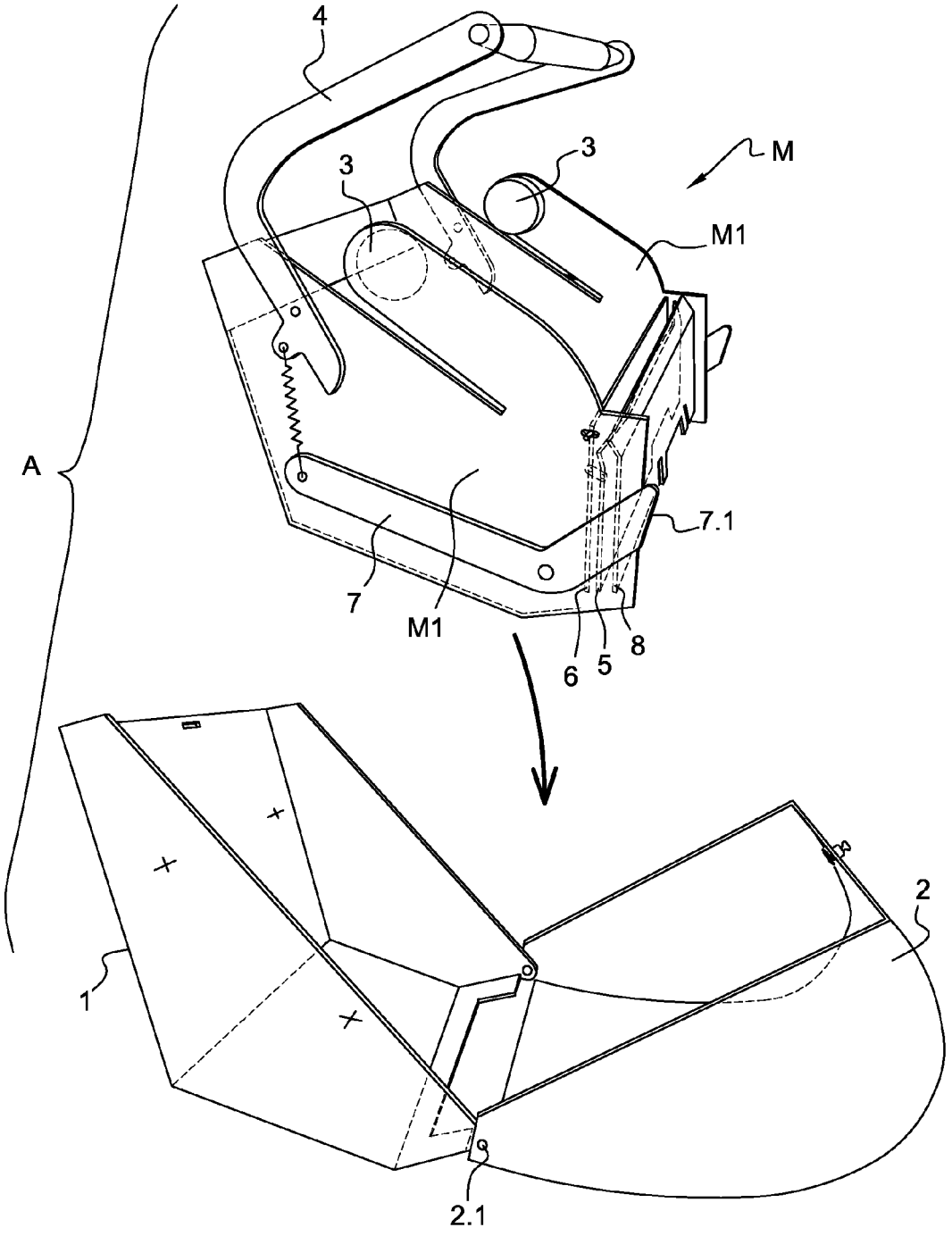
FIG. 1 is a perspective view of the dispenser of pre-cut wiping material with its module before being integrated in the housing-cover assembly.
Figure 2:
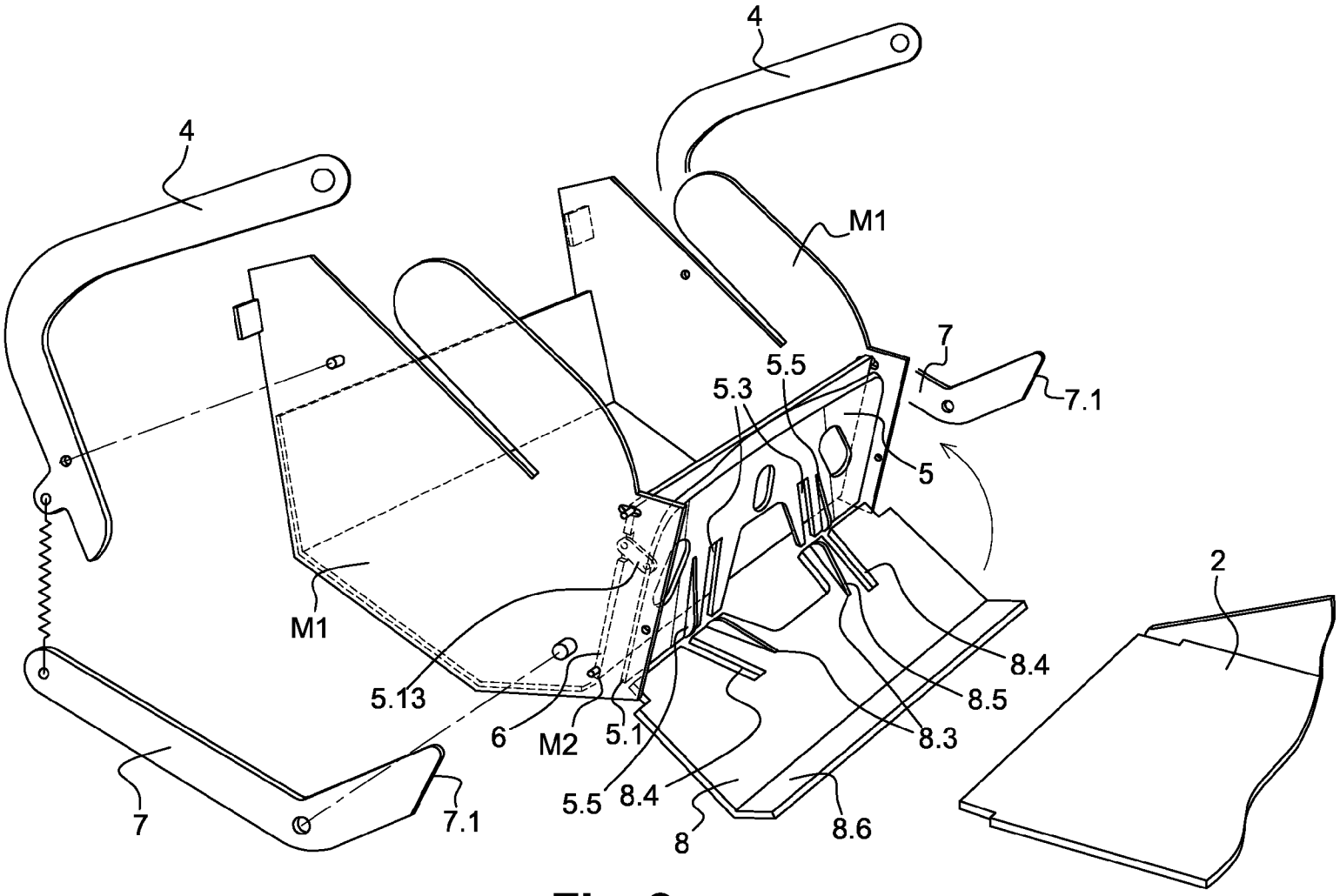
FIG. 2 is a perspective view before assembly of the module, the cover and the flap being separated.
Figure 6:
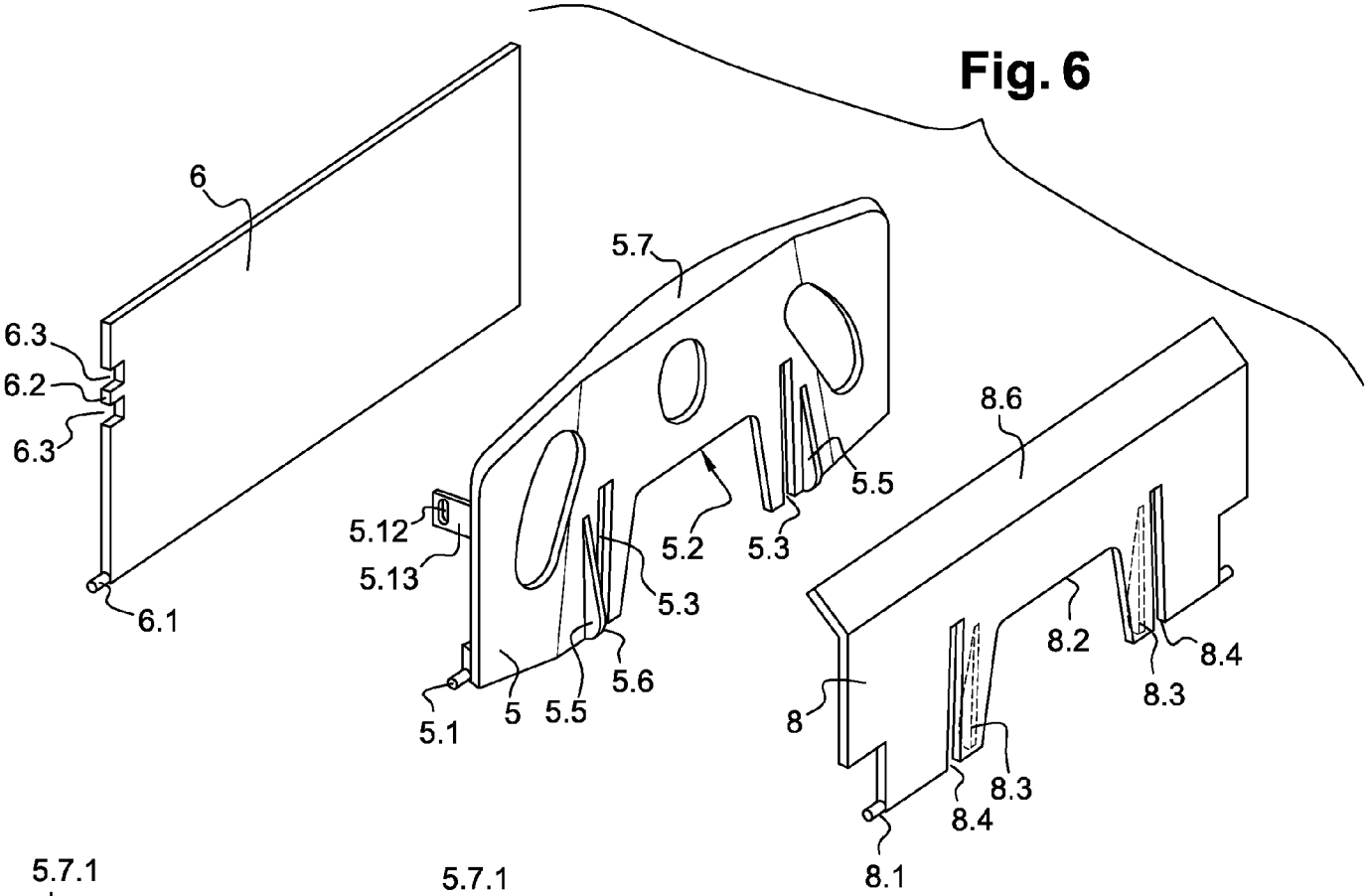
FIG. 6 is a perspective view showing the three components involved in the distribution of the strip of material, that is, the flap, the plate for externally covering the flap and the internal plate.

To make the object of the invention more tangible, it is now described in a non-limiting way illustrated in the drawings.

The pre-cut wiping material dispenser is designated with general reference (A). It comprises a housing (1) with an associated cover (2). The cover (2) is hinged on axes (2.1) to the housing to be raised upwards for its closing and locking. The housing receives a module (M) which is attached thereto by quick assembly/removal means. This module may be arranged to enable to dispense the pre-cut strip of material in a roll configuration. It comprises for this purpose a swivel system (4) which enables, on the one hand, to stretch the strip of material, and on the other hand to ensure the damping function to absorb the shock during the driving of the strip of material due to the inertia of the roll to avoid any breakage of the material. The roll is arranged on tips (3) formed on the lateral flanges (M1) of the module. The module may be fitted at its rear portion with a reservoir for storing a reserve roll of pre-cut material or to store a nearly depleted roll.

In another configuration, the pre-cut strip of material appears in folds and the module forms in its rear portion a reservoir for storing the pile of the strip of material.

In both cases, the swivel mechanism enables to guide and to stretch the strip of material.

Reference numeral (5) designates a pivoting flap located at the front of the module and provided on its edges with swivel axes (5.1) to enable it to pivot towards the back.

Reference numeral (6) designates the front transverse support plate of the module arranged between the lateral flanges (M.1) thereof.

The module further comprises bent levers (7) arranged on either side of the module, outside thereof, and hinged with respect to the module flanges. Such bent levers (7) are resiliently connected to the swivel system (4). The levers have, at their front ends, bearing faces (7.1) specifically cooperating on closing of the cover, as will be discussed hereafter.

The implementation according to the invention will now be described.

Figure 8:
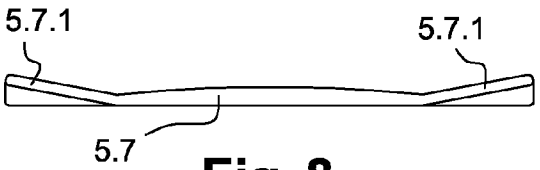
FIG. 8 is a top view of the flap.

The flap (5) as shown in FIG. 3 comprises a central recess (5.2) with, on either side, long slots (5.3) arranged perpendicularly from the lower edge (5.4) of the flap. Adjacent to said slots (5.3) are formed ribs (5.5) having a ramp configuration with a rounded end shape (5.6) adjacent to the lower edge (5.4). In its upper portion, the flap has an upper border (5.7) of curved configuration with recessed ends (5.7.1) on the inner side to define the configuration shown in FIG. 8. The flap further has on its outer apparent surface a dome shape (5.8) and on either side thereof, shapes (5.9) of connection with the lateral edges of said flap. The upper portion (5.7) is substantially curved as appears in FIGS. 5 and 7. This specific shape enables to guide the strip of material. Further, the previously-mentioned flap has one or several cutouts (5.10) (5.11) of oblong configuration, enabling the operator's fingers to pass in the conditions which will be discussed hereafter.

According to the invention, the cover (2) is free of any functional shape capable of cooperating with the previously-mentioned flap (5) thus enabling to adapt the cover to each user's shapes and style.

Figure 7:
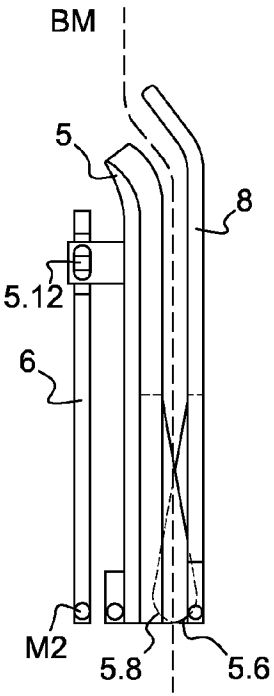
FIG. 7 is a side view showing said elements in position with respect to one another.

In such conditions, the Applicant has designed a plate (8) for covering the flap (5) and for guiding the strip of material, which is capable of replacing the cover. Such a cover plate (8) has connection axes (8.1) which are capable of being hinged with respect to the lateral flanges (M.1) of the module. The cover plate (8) has, complementarily to the ribs (5.5) and slots (5.3), fittings capable of cooperating therewith. More specifically, the cover plate comprises on either side a central recess (8.2) in relation with the recess (5.2) of the ribs (8.3) and slots (8.4) capable of interpenetrating in the slots (5.3) and the ribs (5.5) of said flap. The ribs (8.3) also have a ramp shape with a rounded end (8.5) similarly to the configuration (5.6) of the ramps (5.5) formed on the flap. Thus, as shown in FIG. 7, the rounded ends of the respective ribs (5.6) and (8.5) formed on the flap (5) and on the plate (8) are opposite to one another when the cover plate is raised while the cover is closed. The cover plate (8) has an inward-directed upper border (8.6) on the flap side, and is used to guide the strip of material (BM). As shown in FIG. 5, the cover plate (8) is very high and substantially protrudes from the end of the upper portion of the flap (5). This enables to better guide the strip of material.

The transverse support plate (6) is assembled with the ability to pivot from front to back in the module (M) in close collaboration with the flap (5). The plate (6) has, in its lower portion, swivel axes (6.1) penetrating into openings (M.2) formed on the module flanges (M.1). Along one of its edges, the plate (6) has a finger (6.2) formed between two cutout areas (6.3). Such a finger (6.2) is capable of penetrating into a port (5.12) formed on a plate (5.13) perpendicular to the internal surface of the flap (5). This provides a connection between the flap (5) and the plate (6) in the context of a pivoting of this sub-assembly with respect to the module (M).

Figure 16:
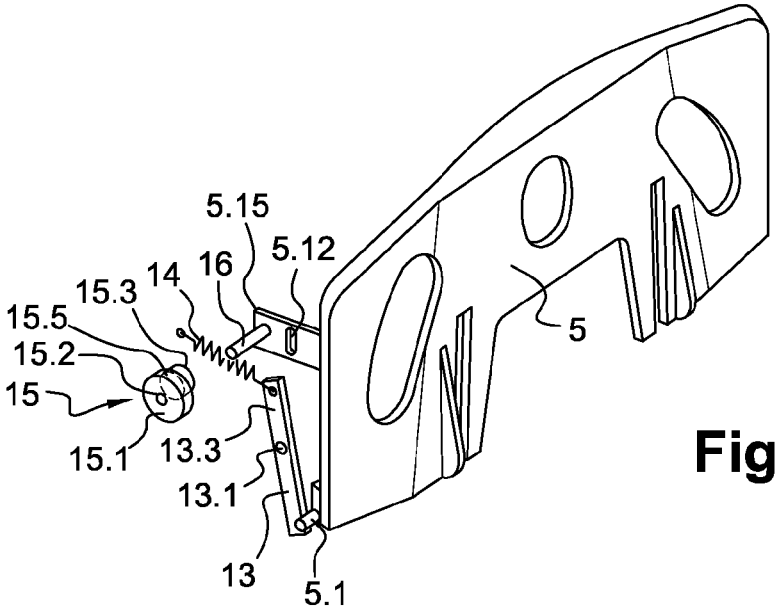
FIG. 16 is a view of the flap integrating a device complementary to the position of the flap and of the associated support plate according to the thickness of the strip of material to be dispensed.
Figure 17:
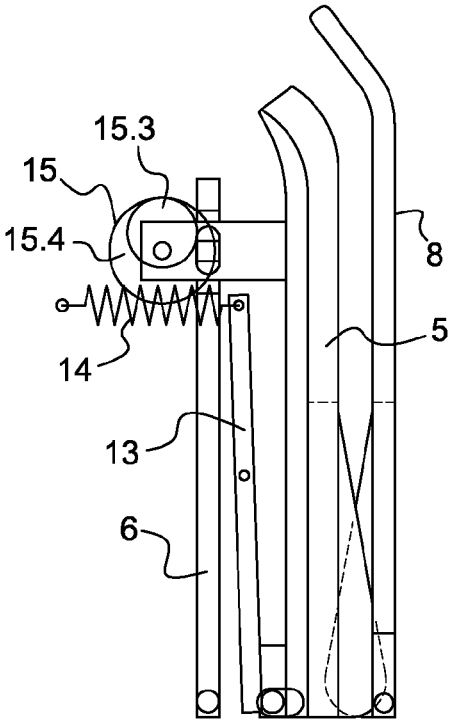
FIGS. 17 and 18 are views illustrating assemblies of a support plate, a flap, and a cover plate associated with the device module and integrating the device of adjustment according to the thickness of the strip of material.
Figure 18:
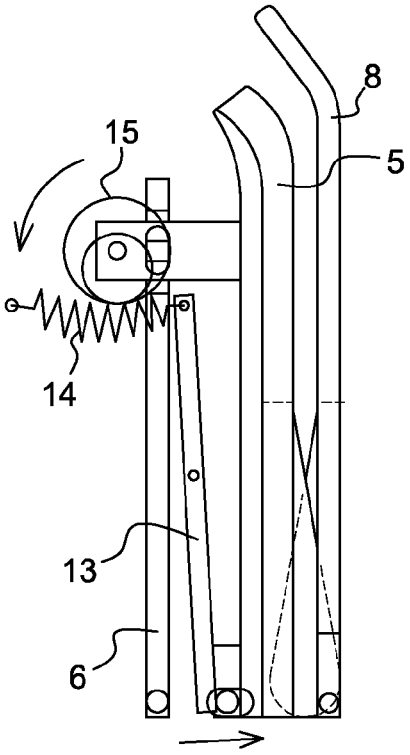

It is further provided to arrange an articulated bar (13) which is pivotally assembled with respect to the flanges opposite to the module by an axis (13.1), illustrated in FIGS. 16 to 18. The lower end of this bar comes into contact with the flap articulation finger (5.1), and the other end (13.3) of the bar receives a tension spring (14) having an end attached to a flange (M.1) of the module. The insertion of the operator's hand in the space formed between the flap (5) and the support plate (6) allows the pivoting of this sub-assembly to separate it or to bring it closer to the cover plate (8).

According to another configuration, said cover plate (8) stops against the bearing faces (7.1) of the bent portions of the levers (7) associated with the swivel mechanism (4) on closing of the cover. The strip of material is capable of passing in the space formed between the flap and the cover plate.

Figure 9:
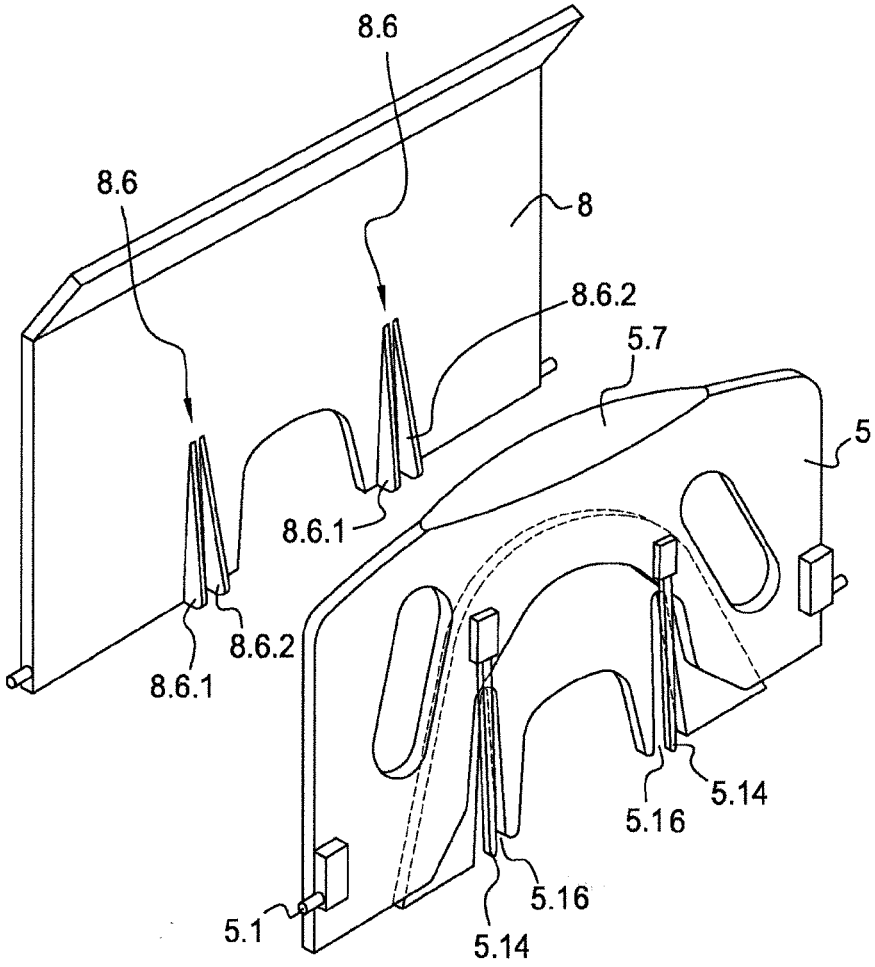
FIG. 9 is a perspective view showing from the back the flap and the cover plate in a second embodiment.
Figure 10:
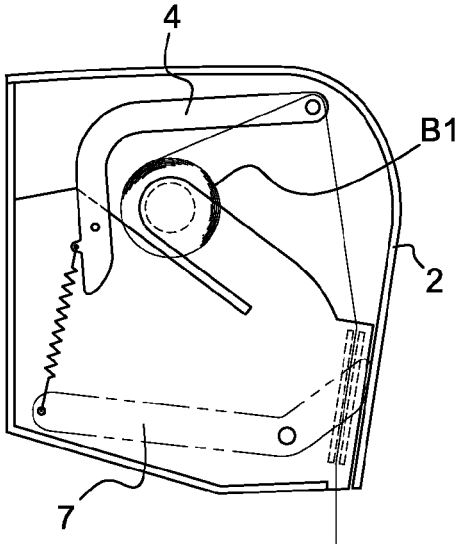
FIGS. 10, 11, 12, 13 are side views showing the loading of the dispensing device according to the invention with a roll of material in service, and then with the installing, in FIGS. 12 and 13, of another roll for the alternated double strip distribution of a format of strip of material successively from a first roll and from a second roll.
Figure 11:
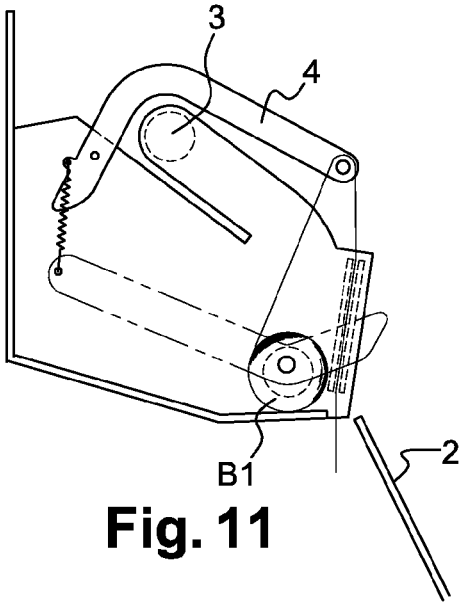
Figure 12:
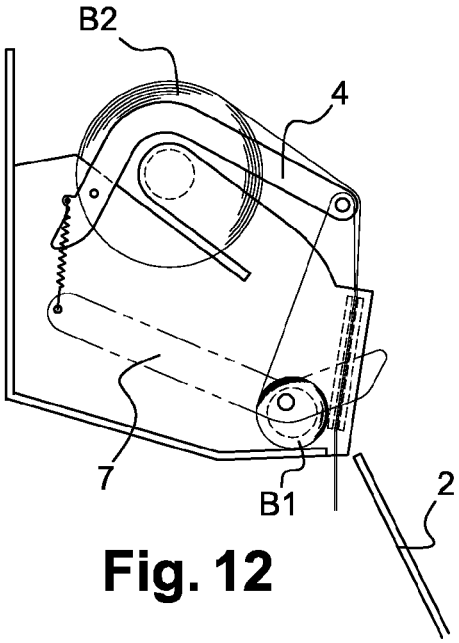
Figure 13:
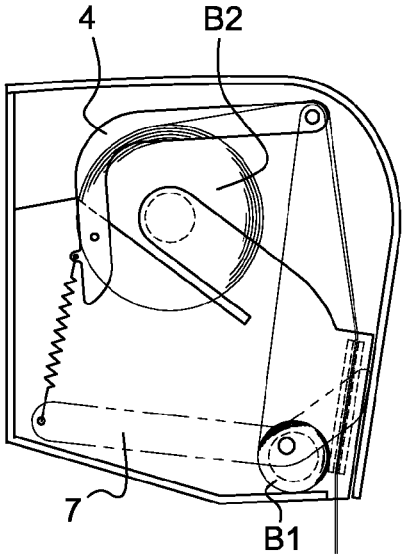

FIG. 9 shows an alternative embodiment of the flap (5) and of the cover plate (8). In such a configuration, the flap (5) has on either side of the central recess a single slot (5.16) with the reception of a complementary tooth-shaped element (5.14) partially superposing in the space formed in said slots. This tooth (5.14) is attached to the upper portion of the flap. The cover plate (8) has on its inner side, complementarily, two ribs (8.6) each formed in two parallel portions (8.6.1) (8.6.2) having a ramp shape with a rounded end profile to engage into the space formed in each of the slots and between the tooth in the corresponding space formed on the flap. This is a previously-described configuration, which may however also be applied in the specific implementation of the present invention.

Reference is now made to FIGS. 10 to 15.

The wiping material dispensing device thus described enables to load a roll (B.1) of material as defined in the previous patent applications, reminded hereabove in the preamble of the application. It is however able and designed to allow the loading of another roll (B.2) of pre-cut material when the first roll (B.1) is nearly depleted. For this purpose, as shown in FIGS. 10 to 13, the nearly depleted roll of material (B.1) is displaced and transferred from its position between the tips (3) arranged on the flanges (M.1) of the module to the lower portion thereof. The strip of material still remains guided by the guide axis of the swivel mechanism between the flap and the cover plate. The installing of a second roll (B.2) of pre-cut material, in FIGS. 12 and 13, enables to perform a double-strip dispensing (BM1) (BM2) of format of strips of material pulled by the user. This arrangement should thus be compared with the specific embodiment described in French patent FR 0957096 of the Applicant.

Figure 15:
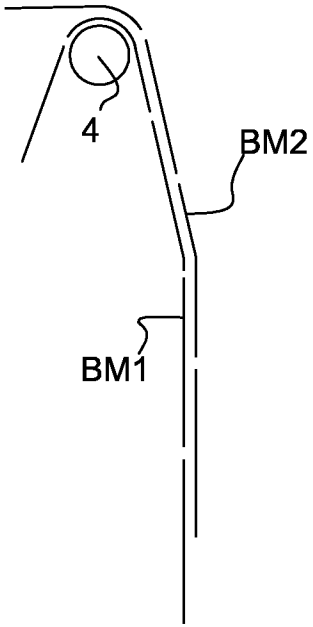
FIG. 15 is a simplified view illustrating the dispensing of strips of material from two rolls.
Figure 14:
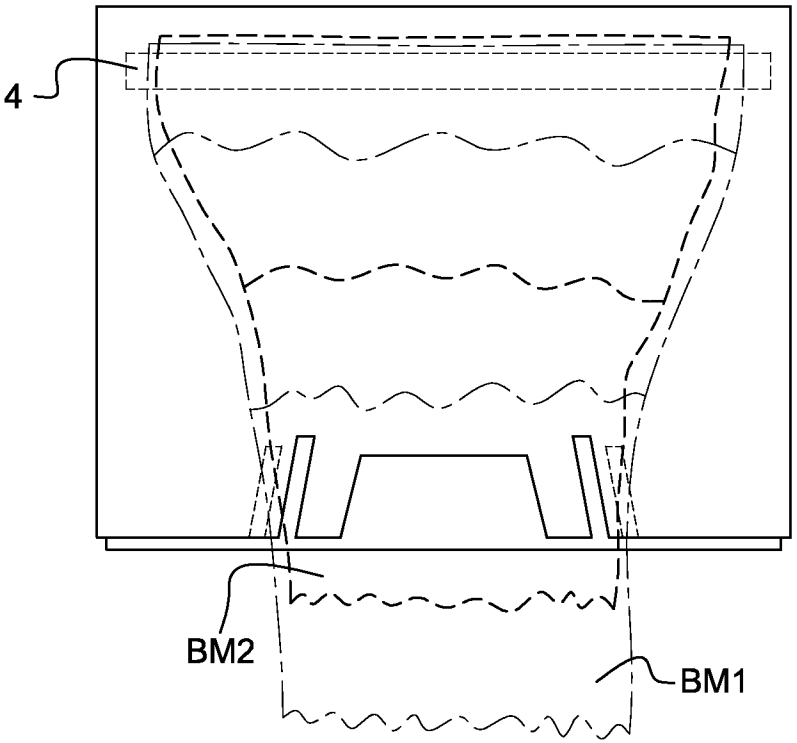
FIG. 14 is a view implementing the principle of the dispensing of a strip of material from a first and a second roll of material.

As shown in FIGS. 15 and 16, the strips of material from the two rolls (B.1) (B.2) are capable of partially overlapping over a distance corresponding to one half format. The driving of a strip of material pulled by the user causes the developing of the other strip which comes in turn after cutting of a sticking-out format, to be grabbed in turn.

The device according to the invention thus enables to alternate the dispensing of strips of material from the two rolls, one nearly depleted, the other one new.

The Applicant has also optimized the concept of the invention by integrating, as shown in FIGS. 16 to 18, a complementary adjustment device which enables to take into account the quality of the strip of material and its thickness.

In this optimized complementary embodiment, the plate (5.13) formed on the flap (5) extends beyond the oblong port (5.12) to form at its end the attachment base (5.15) of a long finger (16) perpendicularly crossing the flange (M.1) of the module. The latter is provided with an oblong port enabling the assembly of the flap (5) and the plate (6) to pivot. This finger (16) is located in a plane above the spring linked to the bar. The end of the finger (16) is capable of receiving an eccentric button (15) which is assembled, clamped or attached thereto, as appropriate. Such an eccentric button comprises a circular ring portion (15.1) having, in its middle, a bore (15.2) for the assembly thereof on the previously-mentioned finger (16). The inner surface of the ring receives a bearing seat (15.3) forming an eccentric offset with respect to the central axis of the ring portion, thus exposing a free area (15.4) on the inner surface of the ring. The eccentric button is advantageously notched (15.5) with adjustment marks. In its initial position shown in FIG. 17, the eccentric button (15) is placed on the finger (16) substantially above the return spring (14) associated with the bar (13). In such a situation, the previously-mentioned spring undergoes no deformation. When the operator desires to modify the position of the sub-assembly formed by the flap (5) and the plate (6) with respect to the cover plate (8) to take into account the basis weight and the thickness of the strip of material, by opening or decreasing the passage clearance necessary for the distribution of the strip of material, the operator will more or less progressively and fully turn the eccentric button. In this case, the eccentric portion will bear against the previously-mentioned spring (14) (FIG. 18), thus causing its deformation and pulling on the bar, which causes the forward tilting of the sub-assembly formed by the flap (5) and the plate (6).

The implementation of this specific arrangement however remains optional. It should be specified that, in the considered applications, the thickness of the strip of material, which is generally a multilayer, may vary between 15 and 60 grams per m2 according to the number of layers or plies forming it.

The device allows a forward tilting of the flap (5) and of the plate (6) by a few degrees, which is sufficient to adjust the pressure with respect to the strip of material.

The advantages well appear from the invention. The optimizing of the use of the device by providing a variable capacity of adapting customized covers, the possibility provided by the device to dispense strips of pre-cut wiping materials from one or two rolls under certain conditions, the possibility of an adjustment for the passing of the strip of material and to limit the jamming phenomenon by adapting the space between the flap and the cover plate according to the thickness of the material should be noted.

Another major advantage of the invention is the configuration of the flap and of the covering plate, which enable to dispense the strip of material without for folds to be formed.

The invention claimed is:

1. A device for dispensing a rolled or folded pre-cut wiping material, comprising:

a housing;

a cover closed by being raised upwards in front of the housing; and a module which is removably received in the housing and which receives a strip of pre-cut wiping material, said module comprising two lateral flanges, bent levers arranged on either side of the module and a swivel system operable, at least in part, by the bent levers, the swivel system capable of stretching and guiding the strip inside the device, wherein the module further includes:

a transverse support plate;

a cover plate pivotally hinged to the lateral flanges; and a flap directly pivotally assembled with respect to the lateral flanges and to the transverse support plate of the module, wherein:

the transverse support plate, the cover plate, and the flap are substantially planar, the flap is arranged in front of the transverse support plate and behind the cover plate and the cover to define a space between the flap and the cover plate to allow the passing of the strip between the flap and the cover plate, the cover plate has an upper end provided with a border directed inwardly toward the flap and protruding above an upper end of said flap so as to guide the strip between said upper end of the flap and said upper end of the cover plate, the flap and the cover plate are provided with respective central recesses facing each other and with one or several slot(s) and one or several rib(s) arranged complementarily on either side of the central recesses, the rib(s) being substantially planar and capable of penetrating into the slot(s) upon closing of the cover, and the flap and the transverse support plate are coupled to each other with a limited pivoting capacity which enables an operator to access an inner volume comprised between the flap and the cover plate.

2. The device of claim 1, wherein the upper end of the flap has a curved border with ends recessed on an inner side of the flap, and the flap has one or several cutouts of oblong configuration allowing the passing of the operator's fingers through the flap.

3. The device of claim 1, wherein the flap includes slots extending from a lower edge of the flap and ribs which are arranged adjacent to said slots of the flap and have a ramp shape with a rounded end adjacent to the lower edge of the flap, and complementarily the cover plate includes slots extending from a lower edge of the cover plate and ribs which are arranged adjacent to said slots of the cover plate and have a ramp shape with a rounded end adjacent to the lower edge of the cover plate, the ribs of the flap being capable of penetrating the slots of the cover plate, the ribs of the cover plate being capable of penetrating the slots of the flap, and the respective rounded ends of the ribs formed on the flap and on the cover plate are directed opposite to one another when the cover plate is raised upon closing of the cover.

4. The device of claim 1, wherein the flap has slots extending from a lower edge of the flap on either side of the central recess of the flap, each slot receiving an elongated element attached to an upper portion of the flap, and complementarily the cover plate has an inner side provided with a pair of ribs on either side of the central recess, each pair of ribs of the cover plate engaging in one of the slots of the flap on either side of the elongated element.

5. The device of claim 1, wherein the transverse support plate has lateral edges with lower portions comprising swivel pins penetrating into openings formed on the lateral flanges of the module, and along one of the lateral edges, the transverse support plate has a finger formed between two cutout areas, said finger being capable of penetrating into a port formed on a leg extending perpendicular to an internal surface of the flap.

6. The device of claim 5, wherein said device comprises an articulated bar pivotally assembled with respect to the lateral flanges of the module, a lower end of the bar comes into contact with an articulation rod of the flap, and an upper end of the bar receives a tension spring having one end attached to one of the lateral flanges of the module.

7. The device of claim 1, wherein a first roll of substantially depleted wiping material is displaced from tips arranged on the lateral flanges of the module to a lower portion defined between said lateral flanges of the module, while a second roll of wiping material is loaded on said tips to perform a double-strip dispensing with alternated distribution wiping material originating from the first roll, and then from the second roll.

8. The device of claim 1, wherein said device comprises a complementary device for adjusting pressure exerted on the strip of wiping material between the flap and the cover plate depending on quality and thickness of the strip of wiping material.

9. The device of claim 6 wherein the finger is attached to the leg formed on the flap and extends through one of the lateral flanges of the module, said finger receiving an eccentric button capable of selectively cooperating with the tension spring to bring a sub-assembly formed by the transverse support plate and the flap closer to or away from the cover plate, and wherein the lateral flange of the module receiving the finger is provided with an oblong port enabling said finger to pivot.

10. The device of claim 9, wherein the eccentric button comprises a ring portion having a central bore for accommodating said finger, a bearing seat is provided on a planar inner surface of the ring portion, said bearing seat forming an eccentric offset with respect to a central axis of the ring portion for exposing a free area on the planar inner surface of the ring portion, and an outer cylindrical surface of the ring portion is provided with adjustment marks.

11. The device of claim 1, wherein the cover plate is pushed by the cover upon closing of the cover and bears against bearing ends of the bent levers which raises or lowers the swivel system.

* * * * *